US005289896A

United States Patent [19]

Giglio

[11] Patent Number: 5,289,896

[45] Date of Patent: Mar. 1, 1994

[54] HARNESS FOR A MOTORCYCLIST AND THE LIKE

[76] Inventor: Salvatore J. Giglio, 4801 Ave. I, Brooklyn, N.Y. 11234

[21] Appl. No.: 942,786

[22] Filed: Sep. 10, 1992

[51] Int. Cl.[5] ..... A62B 35/00

[52] U.S. Cl. ..... 182/3; 244/151 R; 2/312

[58] Field of Search ..... 182/3; 244/151 R; 2/311, 312

[56] References Cited

U.S. PATENT DOCUMENTS

| | | | |
|---|---|---|---|
| 3.004,519 | 10/1961 | Weissman | 182/34 |
| 3,487,474 | 1/1970 | De Meo | 182/34 |
| 3,562,812 | 2/1971 | Greggains | 182/3 |
| 5,080,191 | 1/1992 | Sanchez | 182/3 |
| 5,081,719 | 1/1992 | Donnelly | 182/34 |

*Primary Examiner*—Alvin C. Chin-Shue
*Attorney, Agent, or Firm*—Richard L. Miller

[57] ABSTRACT

A harness is provided for a motorcyclist and the like which consists of a pair of shoulder straps to be worn by a driver of a motorcycle. A waist strap is attached to the shoulder straps, while an upper back strap is attached between the shoulder straps and a lower back strap is attached between the shoulder straps. A pair of grip handles are each attached to one shoulder strap between the upper back strap and the lower back strap, so that a passenger sitting behind the driver on the motorcycle can hold onto the grip handles for anchorage and safety, while the driver will wear the harness in comfort.

5 Claims, 1 Drawing Sheet

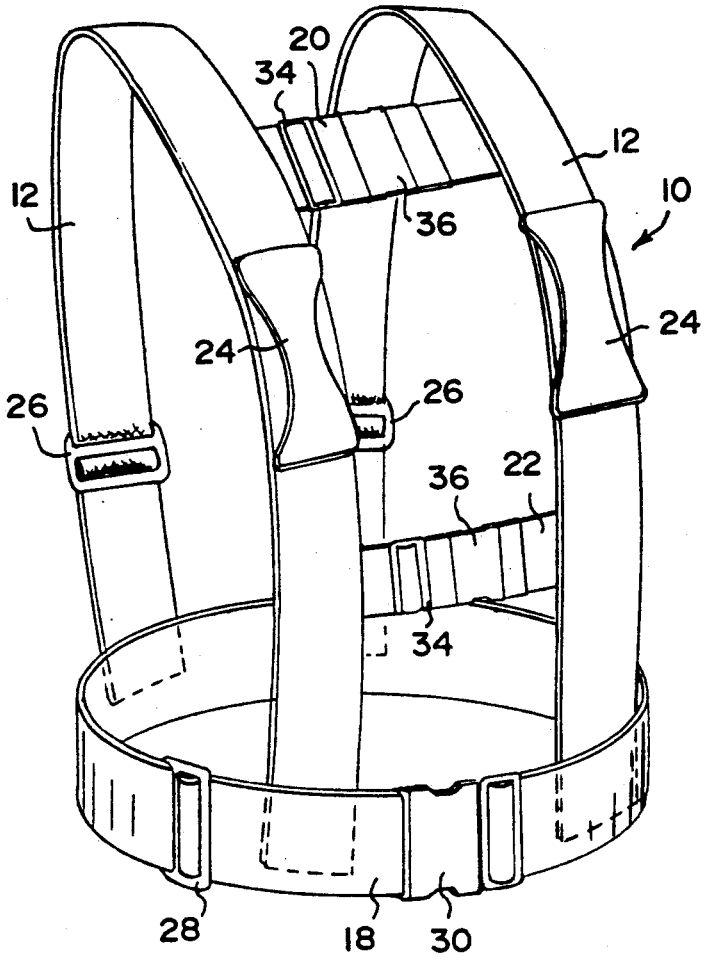
Fig. 1
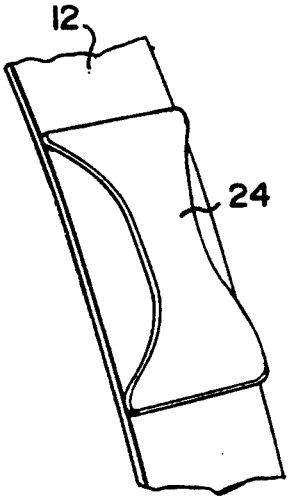
Fig. 2
Fig. 3
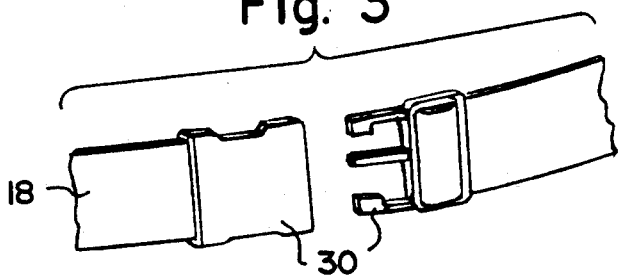
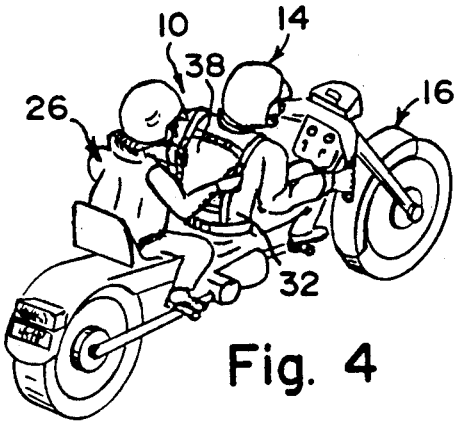
Fig. 4

HARNESS FOR A MOTORCYCLIST AND THE LIKE

BACKGROUND OF THE INVENTION

The instant invention relates generally to accessories for motorcycles and bicycles but more specifically it relates to a harness for a motorcyclists and the like.

Numerous accessories for motorcycles and bicycles have been provided in the prior art that are useful for improving the safety of vehicle riders. Typically some such items are backrests, luggage carriers, child seats and safety harnesses. For example, U.S. Pat. Nos. 3,850,353 to Foulds; 4,053,091 to Martelet and 4,560,097 to Reynolds et al. all are illustrative of such prior art. While these units may be suitable for the particular purpose to which they address, the would not be as suitable for the purpose of the present invention as hereafter described.

SUMMARY OF THE INVENTION

A primary object of the present invention is to provide a harness for a motorcyclist and the like that will overcome the shortcomings of the prior art devices.

Another object is to provide a harness for a motorcyclist and the like that is worn in comfort on a driver of a motorcycle, so that anchorage and safety is supplied to a passenger gripping the harness when sitting behind the driver.

An additional object is to provide a harness for a motorcyclist and the like that is an adjustable to fit comfortably over the driver's torso and is appropriately worn by the driver with built-in grip handles along the back of the shoulder straps of the harness, so that the passenger can rely on the grip handles as a support, which accordingly causes pressure to be uniformly distributed on the torso of the driver.

A further object is to provide a harness for a motorcyclist and the like that is simple and easy to use.

A still further object is to provide a harness for a motorcyclist and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of the instant invention;

FIG. 2 is an enlarged perspective view of a grip handle thereof;

FIG. 3 is a diagrammatic partial perspective view of the fastening mechanism thereof; and FIG. 4 is a diagrammatic perspective view illustrating the invention being used by motorcyclists.

DETAILED DESCRIPTION OF THE PREFERRED EMBODIMENTS

Turning now descriptively to the drawings, in which similar reference characters denote similar elements throughout the several views, the Figures illustrate a harness 10 for a motorcyclist and the like which consists of a pair of shoulder straps 12 worn by a driver 14 of a motorcycle 16. A waist strap 18 is attached to the shoulder straps 12, while an upper back strap 20 is attached between the shoulder straps 12 and a lower back strap 22 is attached between the shoulder straps 12. A pair of grip handles 24 are each separately attached to one shoulder strap 12 between the upper back strap 20 and the lower back strap 22. A passenger 26 sitting behind the driver 14 on the motorcycle 16 can hold onto the grip handles 24 for anchorage and safety while the driver 14 wears the harness 10 in comfort.

Each shoulder strap 12 contains an adjusting buckle 26 for altering the size of the shoulder strap 12. The waist strap 18 contains an adjusting buckle 28 for altering the size of the waist strap 18, while a fastening mechanism 30 is for placing and attaching the waist strap 18 about the waist 32 of the driver 14. The fastening mechanism 30 can be of the quick release type illustrated in FIG. 3 similar to those quite often found on vehicle seat belts, life jackets and parachutes or alternatively an ordinary buckle with tongue/prong and strap with corresponding mating hole not illustrated, or an infinite variety of other device to numerous to mention. The upper and lower back straps respectively 20 and 22, each includes an adjusting buckle 34 for altering their sizes and a fastening mechanism 36 similar to 30 for attaching the upper and lower back straps 20 and 22 across the back 38 of the driver 14.

In operative use the harness 10 is donned by the driver 14 placing his/her right and left arms through the appropriate shoulder straps 12 and accordingly securing the mating fastening devices across his/her back 38. All of the adjusting buckles that is 26, 28, and 34 are then set for a comfortable fitting of the harness upon the torso of the driver. It is to be noted that the fastening device are all at the rear of the driver so that in the event that a device should unexpectedly fail or inadvertently open the harness 10 can not become entirely disengaged from the driver 14. The passenger can then hold onto the grip handles 24 behind the driver 14 when sitting on the motorcycle. It is also to be distinctly understood the instant invention need not be strictly limited to use by motorcyclist and may also be extremely useful for other sports and activities, typically sky divers, rescue workers, deep sea divers and others.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A harness for a motorcyclist and the like which comprises:

a) a pair of shoulder straps to be worn by a driver of a motorcycle;

b) a waist strap attached to said shoulder straps;

c) an upper back strap attached between said shoulder straps;

d) a lower back strap attached between said shoulder straps; and e) a pair of grip handles, each attached to one of said shoulder strap between said upper back strap and said lower back strap, so that a passenger sitting behind the driver on the motorcycle can hold onto said grip handles for anchorage and safety while the driver wears said harness in comfort.

2. A harness for a motorcyclist as recited in claim 1, wherein each said shoulder strap includes an adjusting buckle at a back of the harness for altering the size of said shoulder strap.

3. A harness for a motorcyclist as recited in claim 2, wherein said waist strap includes:

a) an adjusting buckle at a back of the harness for altering the size of said waist strap; and b) a fastening mechanism at a back of the harness for placing and attaching said waist strap about the waist of the driver.

4. A harness for a motorcyclist as recited in claim 3, wherein said upper and lower back straps, each includes:

a) a adjusting buckle for altering their sizes; and b) a fastening mechanism for attaching said upper and lower back straps across the back of the driver.

5. A harness for a motorcyclist as recited in claim 4, wherein at least one of said fastening mechanism for attaching straps is of a quick release type.

* * * * *